United States Patent [19]

Bradford et al.

[11] Patent Number: 4,869,053

[45] Date of Patent: Sep. 26, 1989

[54] QUICK RELEASE SAFETY ATTACHMENT FOR A STIRRUP

[76] Inventors: Buck Bradford, 2763 Hwy. 87 East, Billings, Mont. 59101; Michael J. McCoy, 2629 Red Bridge Rd., Laurel, Mont. 59044

[21] Appl. No.: 235,533

[22] Filed: Aug. 24, 1988

[51] Int. Cl.[4] ..... B68C 3/00

[52] U.S. Cl. ..... 54/49

[58] Field of Search ..... 54/47, 48, 49

[56] References Cited

U.S. PATENT DOCUMENTS

| | | | |
|---|---|---|---|
| 1,050,658 | 1/1913 | Hunt | 54/49 |
| 2,935,833 | 5/1960 | Woodhead | 54/48 |
| 3,157,977 | 11/1964 | Kitchingham, Jr. | 54/49 |

FOREIGN PATENT DOCUMENTS

| | | | |
|---|---|---|---|
| 25860 | of 1905 | United Kingdom | 54/49 |

*Primary Examiner*—Robert P. Swiatek

*Attorney, Agent, or Firm*—Jacobson and Johnson

[57] ABSTRACT

A stirrup for a horse riding saddle has a cylindrical bolt attached across its open end which, in a conventional fashion, rests in the bottom loop of a stirrup strap which in turn is attached to the saddle fender to hold the stirrup in place. The bolt comprises a cylindrical sleeve with movable pins or rods having keyed outer ends extending axially out of the sleeve for engaging keyed openings at the open end of the stirrup and a spring within the sleeve applies a force to the pins to disengage them from the keyed openings while a greater and opposite force is applied by radially extending finger means to hold the pins in place. If the stirrup swings in an arc with respect to the stirrup strap which exceeds a predetermined angle the force applied by the finger is disengaged from the pins so that the force of the spring takes over and disengages the pins from the keyed openings in the stirrup to allow the stirrup to fall free.

14 Claims, 3 Drawing Sheets

QUICK RELEASE SAFETY ATTACHMENT FOR A STIRRUP

FIELD OF THE INVENTION

This invention is for use with the stirrup of a horse riding saddle and, more specifically, provides a mechanism for quickly releasing the stirrup from its attachment to the saddle in the event of an injury-threatening emergency.

DESCRIPTION OF THE PRIOR ART

Conventionally, a stirrup is generally U-shaped having a closed bottom serving as a rest for the rider's foot and is attached to the saddle via a saddle leather or strap by a bolt or bar extending across the open end of the stirrup which rests in the bottom loop of the stirrup strap which is attached to and extends downward from a saddle fender. The stirrup strap is adjustable so that the stirrup can be raised or lowered to accommodate riders of different heights. Normally, when mounted, the rider's feet rest in the stirrup and the rider usually uses the stirrup for mounting. If the rider's foot should become caught or entangled in the stirrup when the rider is out of the saddle and the horse should start to run, the rider would be dragged along by the horse and likely be severely injured, if not worse. This could happen if the rider is thrown from or otherwise falls out of the saddle or could happen while the rider is mounting or dismounting.

SUMMARY OF THE INVENTION

The stirrup bolt or bar which extends across the open end of the stirrup and rests in the bottom loop of the stirrup strap for attaching the stirrup to the stirrup strap, is a hollow cylinder or sleeve with an axially extending pin or rod movably nested within the sleeve with the outer end of the pin keyed to engage a keyed opening or recess at the top open end of the stirrup. Flexible means in the sleeve, preferably in the form of a helical spring in compression, applies an axial force on the pin urging it out of engagement with the keyed opening in the stirrup. Means, such as an arm or bar extending radially from the interior of the sleeve upward within the sides of the stirrup strap applies a force on the pin which is opposite the spring force, and further compresses the spring to hold the pin in engagement with the recess or opening. When the stirrup swings in an arc with respect to the stirrup strap or the sleeve greater than a predetermined angle, which occurs if the rider's foot should get entangled in the stirrup while out of the saddle and the horse starts to move, the force applied to the rod by the arm is automatically released so that the spring force takes over to disengage the pin from the keyed opening in the stirrup and thereby release the stirrup from the bolt and stirrup strap so that the rider is not dragged by the horse.

As a further feature the spring is attached to the sleeve to provide a torsional force to somewhat limit the stirrup from swinging too freely when not in use. Otherwise the stirrup might accidentally detach while the saddle is being placed on or removed from the horse, for example.

DESCRIPTION OF THE PREFERRED EMBODIMENT

Figure 1:
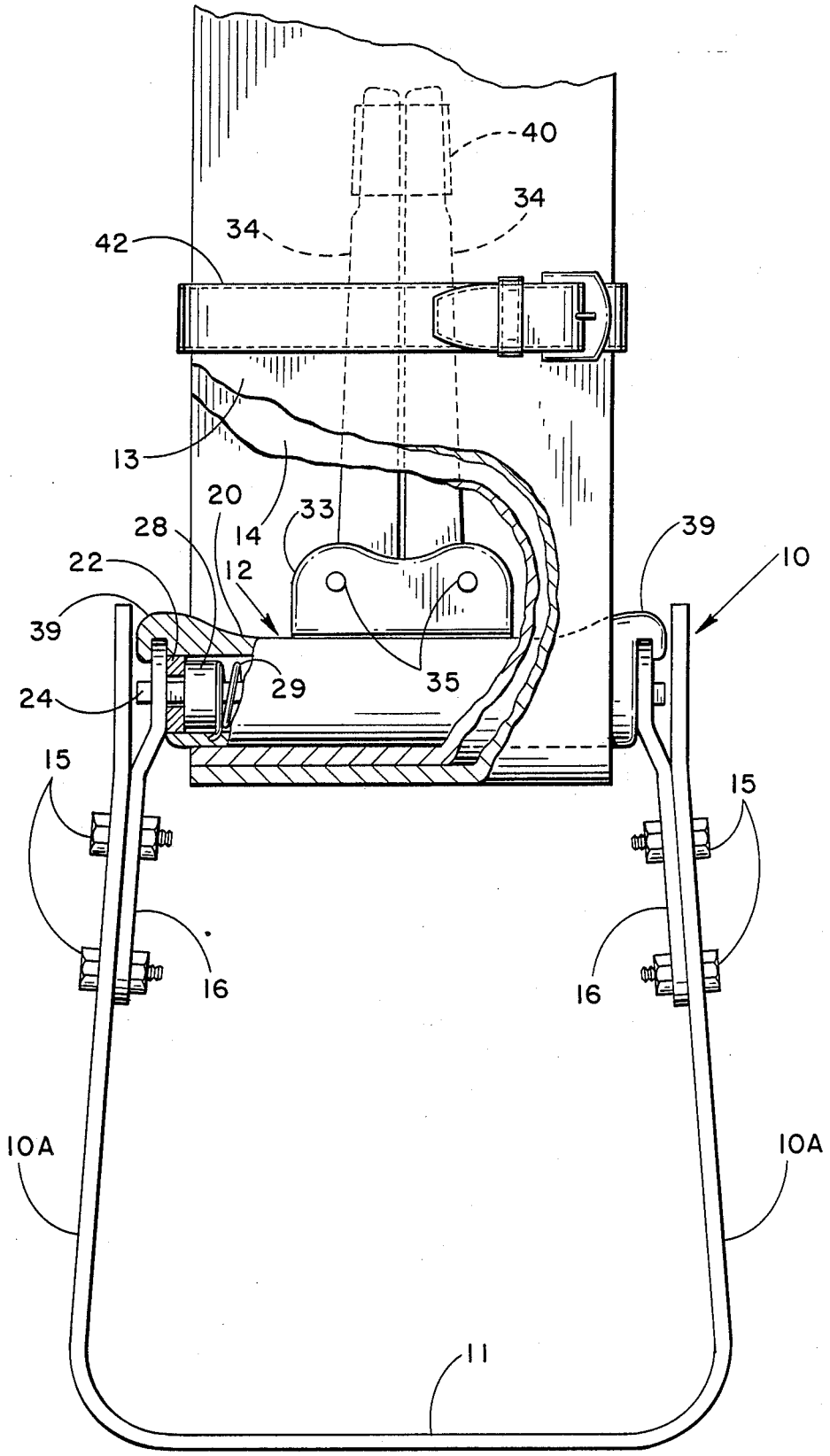
FIG. 1 is a partial breakaway illustration of a preferred embodiment of the invention mounted to hold the stirrup attached to the stirrup strap.

Conventionally, a generally U-shaped stirrup 10 is closed at the bottom to provide a foot rest 11, has opposite side members 10A extending upward from foot rest 11, and is open at its top end and has a cylindrical stirrup bolt or rod extending across the open end for attaching the stirrup to a stirrup strap 13. Stirrup strap 13 extends downward along the side of the horse from a saddle fender, not shown, and is folded back on itself to have two sides or runs and a closed loop 14 at its lower end. The stirrup bolt rests on the closed loop 14 of stirrup strap 13 and stirrup 10 hangs down from the bolt and strap 13. Also, conventionally, stirrup strap 13 has a buckle, not shown, so that the runs or sides of stirrup strap 13 can be lengthened or shortened to raise and lower the stirrup to accommodate riders of different heights. Ordinarily, the stirrup bolt is permanently attached across the open end of the stirrup, or may be attached in some fashion that is intended to be permanent. For example, an elongated threaded bolt held in place by a mating nut might be used. This arrangement can be removed but is rarely if ever done and does not provide a quick disconnect in case of an emergency. The instant invention provides a safety stirrup bolt 12 which will release quickly and automatically in certain emergencies, i.e., if the rider's foot is caught in the stirrup and there is danger of being dragged along the ground by the horse.

Attached to the interior of the sides 10A of stirrup 10 by nuts and bolts 15, or by some other suitable arrangement, are brackets 16 which have a rectangular or otherwise keyed opening or recess 17 at the upper end. Alternatively, of course, the keyed recesses 17 can be formed in the stirrup itself. In any event it will become apparent that virtually all stirrups can be easily modified to work with the quick release bolt of the instant invention. Stirrup bolt 12 includes an outer cylindrical sleeve 20 with an opening 21 at each end surrounded by an interior shoulder 22. Within sleeve 20 are elongated axially extending pins or rods 23 which have rectangular or other key shaped ends 24 for engaging corresponding keyed openings 17 in brackets 16. Attached to the other or inner ends of pins 20 are slotted caps or heads 25. Washer-like annular spacers 28 having a central opening to allow pins 23 to pass through may be located at each end of the cylinder opening resting against shoulders 22. A helically wound spring 29 around each of pins 23 rests at one end against pin cap or head 25 and at its other end against spacer 28. As will become more apparent later, spacer 28 is provided merely to insure that in use spring 29 will be sufficiently compressed to exert enough force to pull the end 24 of pin 23 out of the keyed recess 17 when the compression is released. Alternatively, spacers 28 could be eliminated and the one end of the spring could rest against the interior of shoulder 22. A stop 30 is located at about the center lengthwise in sleeve 20 to limit the inward travel of pins 23, as will be explained later.

Attached to and extending upward from sleeve 20 is a bracket or flange 33 and a pair of upwardly extending lever arms 34 are each pivotably attached at 35 to bracket 33. At the lower end of each arm 34 is a finger 36 which passes through a slotted opening 37 in cylinder 20 radially inward into the cylinder to make contact with the cap or head 25 of pin 23. At each outer end sleeve 20 has a hook 39 for engaging the top end of bracket 16, as best illustrated in FIG. 1.

Figure 2:
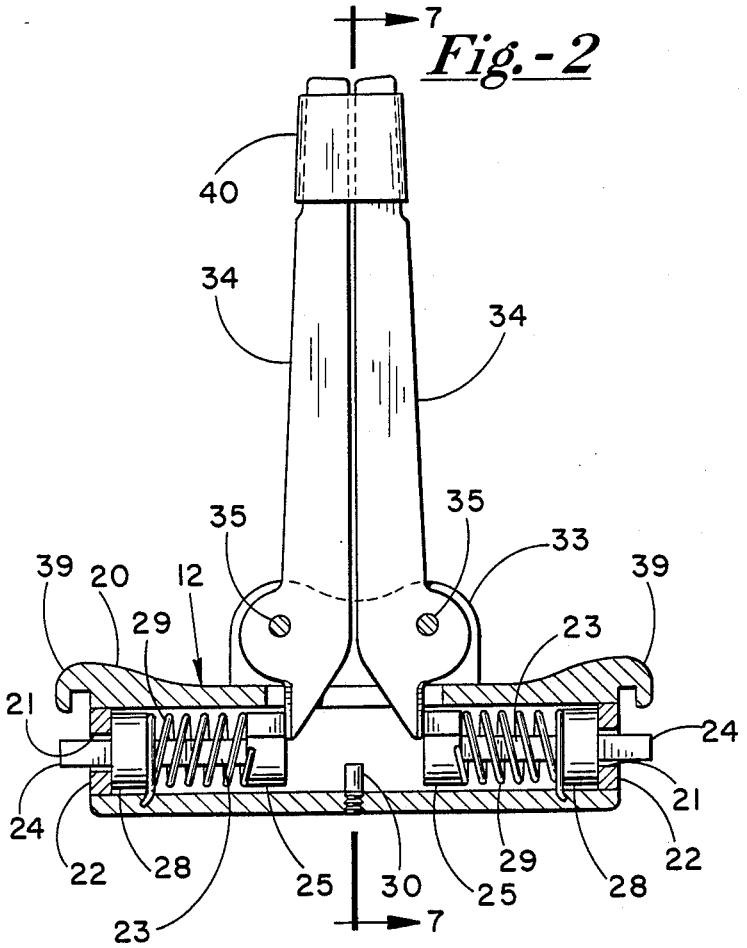
FIG. 2 is a sectioned view of a preferred embodiment of the invention as it appears primed for holding the stirrup attached.
Figure 4:
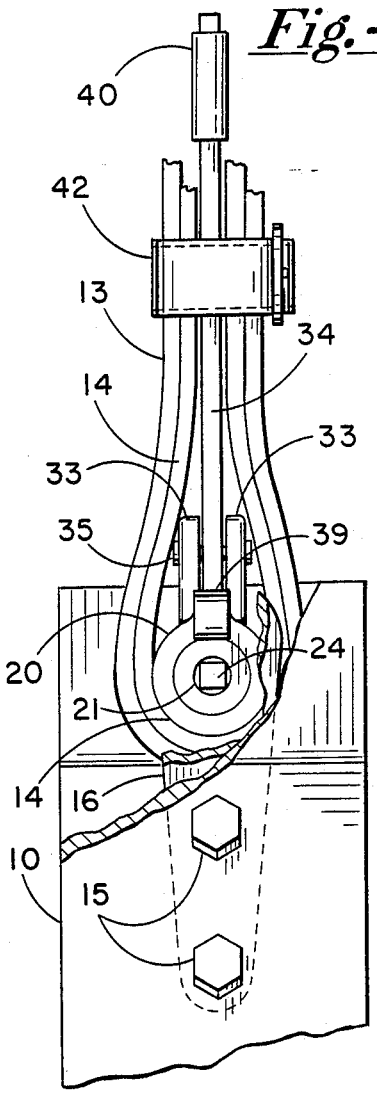
FIG. 4 is an end or side view of the embodiment illustrated in FIG. 2.
Figure 3:
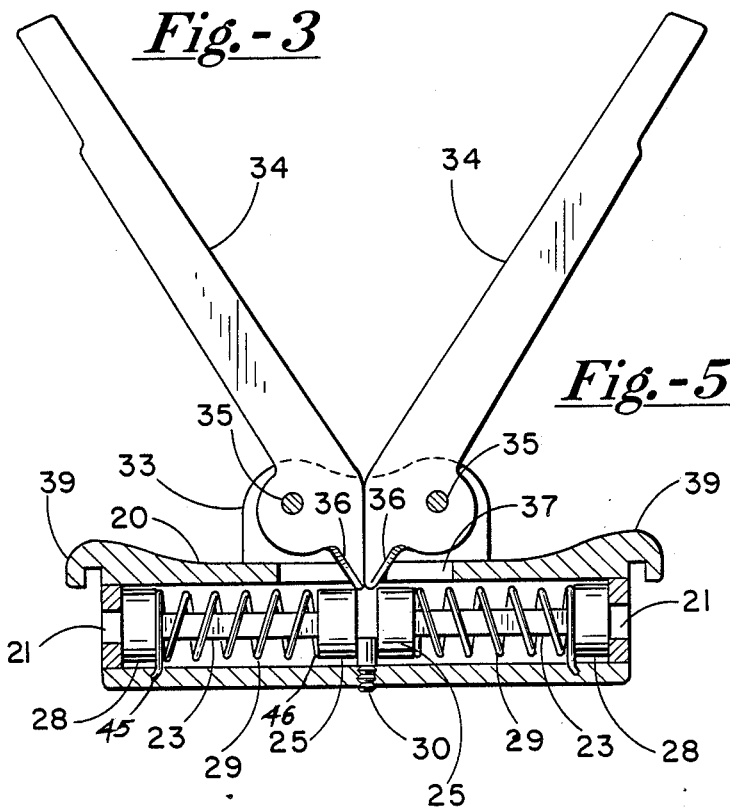
FIG. 3 is similar to FIG. 2 illustrating the preferred form of the invention prior to setting it or priming it to hold the stirrup attached.
Figure 5:
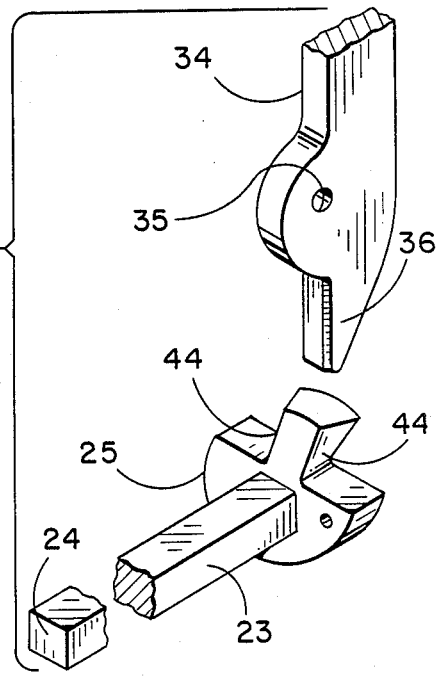
FIG. 5 is a somewhat exploded diagramatic view of part of the holding and release mechanism used in the preferred form of the invention.
Figure 6:
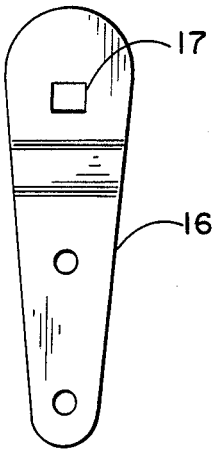
FIG. 6 is an illustration of a bracket which can be attached to the stirrup for attaching the release mechanism to the stirrup.
Figure 7:
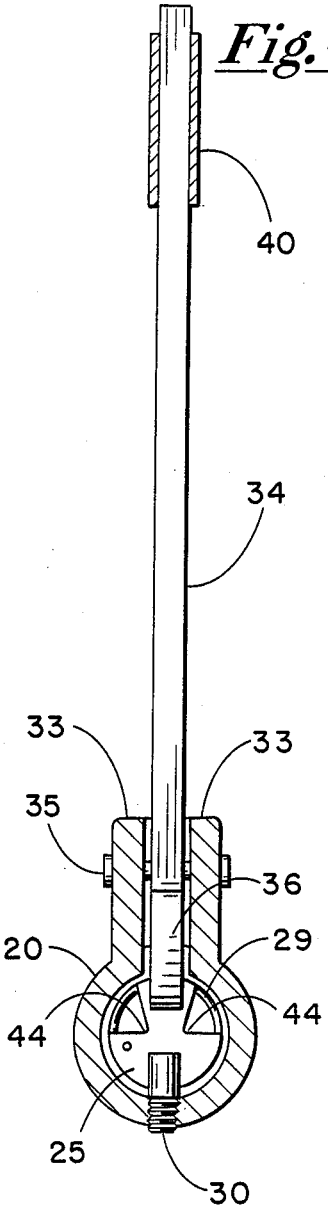
FIG. 7 is a section view of a preferred embodiment of the invention in the primed or cocked condition as viewed along section line 7—7 of FIG. 2.

Prior to priming or cocking stirrup bolt 12 for attaching the stirrup 10 to strap 13, as best illustrated in FIG. 3, spring 29 is lax or partially compressed. In any event it provides sufficient force against cap 25 to draw pin 23 into cylinder 20 so that the end 24 of pin 23 does not extend out from beyond the end of sleeve 20. Stop 30 prevents caps 25 from butting against one another even when completely drawn inward so the gap therebetween permits the fingers 36 of arms 34 to make contact with caps 25 at least along an edge thereof. To prime or cock bolt 12, as illustrated in FIG. 2, arms 34 are pivotally swung together so that the fingers 36 contact caps 25 to press or bear against caps 25 to apply an axial force on pins 23 to extend them out the ends of cylinder 20 so that their ends 24 engage the keyed recesses 17 in brackets 16, not shown in FIG. 2. This action of arms 34 further compresses spring 29. FIGS. 1 and 4 illustrate the manner in which the primed stirrup bolt 12 holds stirrup 10 attached to stirrup strap 13. In FIG. 4 stirrup 10 and bracket 16 are partially broken away for clarity. Cylindrical bolt 12 rests in the loop 14 at the bottom end of stirrup strap 13 and arms 34 are held together by a band 40 and extend vertically upward radially outward from sleeve 20 between the vertically extending runs or sides of stirrup strap 13. An adjustable cross-strap 42 holds arms 34 sandwiched between the run or sides of stirrup strap 13. For ease of explanation the operation of the invention will first be described without the rider being mounted. As illustrated in FIGS. 1 and 4, the saddle fender, not shown, the stirrup strap 13 with arms 34 sandwiched therebetween, bolt 12 and stirrup 10 can be considered to be in a common vertical plane along a side of the horse. The keyed ends 24 of pins 23 engage the keyed openings or recesses 17 in bracket 16 by virtue of the axial force applied to pins 23 by fingers 36 on the lower ends of arms 34 in opposition to the force of springs 29. Referring to FIG. 5, the caps or heads 25 of pins 23 have slots or cutout portions 44. In the primed condition for holding stirrup 10 attached to stirrup bolt 12, fingers 36 of arms 34 apply a force against pin caps 25 in an unslotted area to compress springs 29 and to hold pins 23 engaged with the keyed openings 17. When stirrup 10 swings in an arc about the axis of bolt 12, out of the common plane, pins 23 and caps 25 are caused to rotate about the axis of sleeve 20 by the keyed recesses 17. At some angle of rotation fingers 36 will reach gaps 44 in caps 25 so they no longer bear against or are in contact with caps 25 and this triggers the disconnect mechanism because the force applied by arms 34 is removed from pins 23 permitting the compression force of springs 29 to take over and withdraw or pull pins 23 from engagement with keyed recesses 17 so the stirrup will now fall free from stirrup bolt 12 and from its attachment to stirrup strap 13. In certain emergencies, such as when the rider is out of the saddle but has one foot caught in the stirrup and the horse starts to trot or gallop, the stirrup will swing to bring into play the quick disconnect and release in the manner as described. In actual use, when the rider is mounted and is seated in the saddle with a foot resting on stirrup foot rest 11, normally the foot is turned to face in the same direction as the horse thereby turning stirrup 10 so that it is in a generally vertical plane which is about 90 degrees to the unmounted condition. This twists stirrup strap 13 with respect to the saddle fender but the bottom closed loop 14 of the stirrup strap and bolt 12 turn with the stirrup so that the relative angular locations are the same as described previously. If, while riding, the rider should fall from the saddle with a foot entangled or caught in the stirrup or if when mounting or dismounting the rider's foot should become entangled in the stirrup and the horse should start to run, the stirrup will swing in an arc about the axis of the stirrup bolt 12 as described earlier to disengage tooth 36 from pin cap 25 to thereby release the stirrup in a manner as described hereinabove.

The face of tooth 36 bearing against the surface of cap 25 provides a frictional force which helps to somewhat reduce the possibility of the stirrup swinging too freely or easily which might cause the release mechanism to trigger and disengage the stirrup even when not in use. Additionally, spring 29 at one end 45 can be imbedded into or otherwise attached to sleeve 20 and at its other end 46 partly lap over the outside of cap 25 to provide a torsional force to further resist the free swinging of the stirrup. For an example, when the saddle, with stirrup attached, is being removed from or being placed on the horse the stirrup may have a tendancy to swing too far and accidentally trigger the release mechanism. Another example is the case of a child, whose foot does not set on the stirrup foot rest 11, so the stirrup may swing while the child is riding the horse and accidentally trigger the release. The aforementioned friction between the tooth 36 and cap 25 along with the torsional force of spring 29 minimizes the possibility of a free swinging stirrup accidentally triggering the disconnect mechanism of the stirrup bolt.

Figure 9:
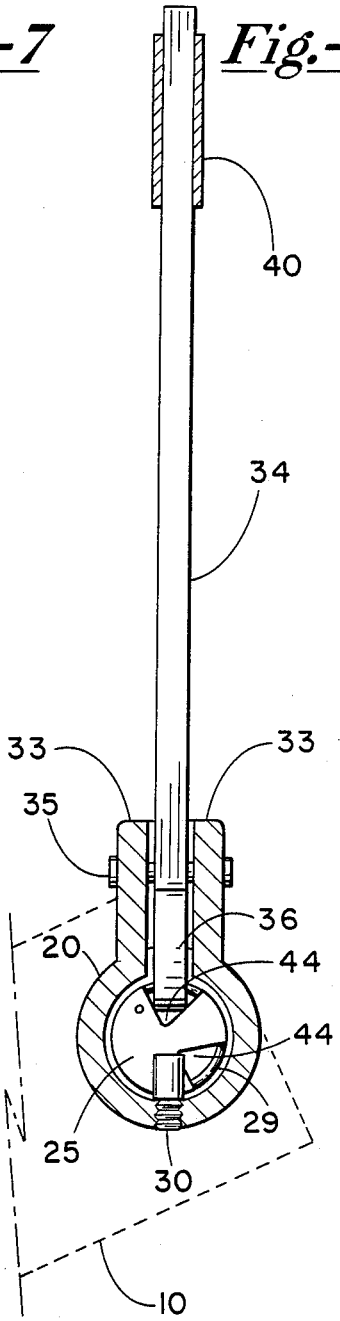
FIG. 9 is a section view as viewed along viewing lines 9—9 of FIG. 8.
Figure 8:
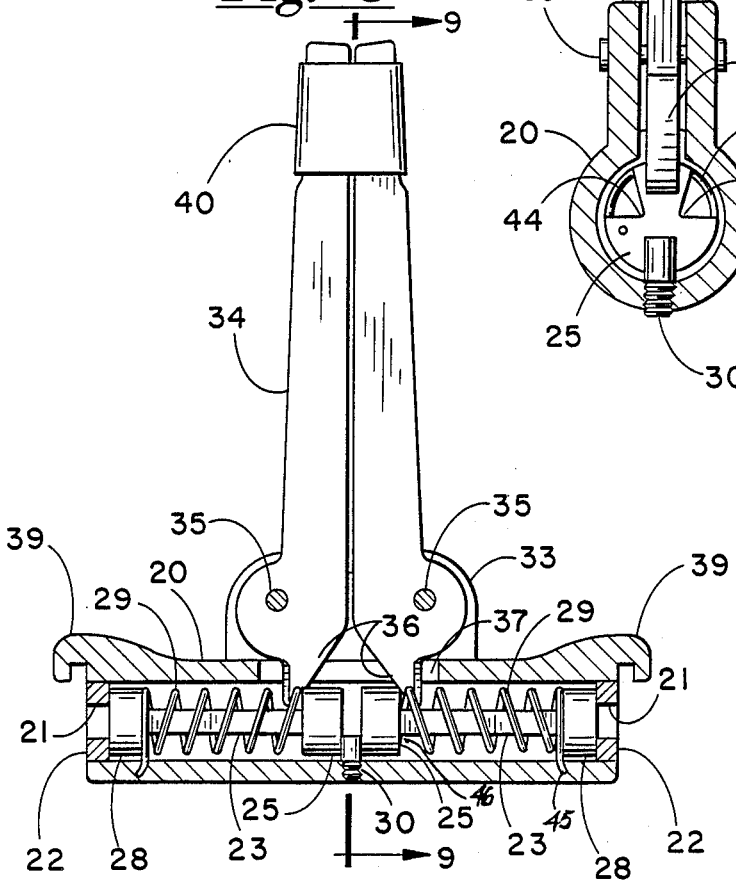
FIG. 8 is a view similar to FIG. 2 but showing the mechanism in the triggered or released condition.

FIGS. 8 and 9 illustrate the released condition. When stirrup 10, shown in phantom line in FIG. 9 for clarity, reaches a predetermined angle with respect to the axis of sleeve 20, finger 36 on arm 34 lines up with a slot 44 in pin cap 25 so that the force applied by arm 34 is no longer applied against the pin cap so that the compression force of spring 29 takes over, driving or forcing pin 23 inward to disengage from keyed opening 17 on bracket 16 which is attached to stirrup 10 thereby releasing stirrup 10. Preferably, as shown best in FIG. 5, the edges of finger 36 and gaps 44 are rounded and/or tapered to minimize the possibility of any marginal hangup between the two when the two are brought into alignment to trigger the release.

To reset the mechanism for reuse, band 40 is removed and pin 23 rotated so that the fingers 36 align with gap 44 and then arms 34 are swung apart so that the fingers are brought into the space between the pin caps 25 as provided by stop 30 and then the pins are rotated so that the fingers 36 contact pin caps 35 in an ungapped area, as illustrated in FIG. 3, and then the arms are brought back together so that fingers 36 bear against caps 35 to prime or cock the mechanism as illustrated in FIG. 2 and as described earlier.

Cross-strap 42 can be used to vary to some degree the amount of swing of the stirrup before the release mechanism is triggered. When strap 42 is tight so that arms 34 are held firmly between the sides or runs of stirrup strap 13 the arms will substantially prevent any significant rotation of sleeve 20 so that the mechanism will trigger at the preset angle. This angle is measured between the location of finger 36 when it is in contact with pin cap 25 in the primed condition and its location where it is fully in gap or slot 44 to release. If cross-strap 42 is loosened so that arms 34 are held quite loosely between the sides of stirrup strap 13, some small amount of rotation of sleeve 20 will take place therefore the stirrup can swing a greater angle before it triggers the release mechanism. It can be seen that a number of factors will influence the angle at which the release is triggered such as the tightness of cross-strap 42, the location and size of gaps or slots 44 on pin cap 25 and the initial placement of finger 36 on cap 25 when the mechanism is primed.

As an alternate, instead of using the pivotably attached arms 34, the mechanism can be primed or cocked manually by inserting a flat tool, such as the blade of a pen knife, through slot 37 into the interior of sleeve 20 and pressing against the pin cap 25 to compress spring 29 and push rod 23 to extend outward so that its end engages the keyed opening 17. In this alternative case, a finger extending radially inward from the wall of sleeve 20 is used to hold the rod and the compressed spring in the primed or cocked condition. The pin head or cap 25 has to be turned sufficiently to allow the finger to pass through slot or gap 44 when the priming force is applied and then rotated so that the cap rests against the finger in an unslotted area to hold the mechanism primed. Also, in this alternate construction, an upwardly extending arm (similar to arm 34) can be fixedly attached (rather than pivotably attached) to sleeve 20 and would extend upward between the sides of stirrup strap 13 and secured by cross-strap 42 in the same fashion as described earlier. The arm held in place in this fashion would then substantially prevent sleeve 20 from rotating so that when stirrup 10 swings in an arc of sufficient angle, rod 23 will be rotated until the arm or dog reaches gap 44 to trigger the release mechanism and allow the stirrup to fall free. In lieu of an upwardly extending arm, other means can be used to hold sleeve 20 substantially non-rotatable in the bottom loop of stirrup strap 13. For example, a suitable adhesive or a loop-and-hook fastener (such as commonly known under the trademark Velcro) or barbs can be placed on the outside of the sleeve to keep it from rotating.

I claim:

1. In combination with a horse saddle fender, a stirrup strap extending downward from said fender folded back on itself forming a loop at its bottom end, and a stirrup extending down from said stirrup strap, said stirrup having an open upper end and a closed foot-support lower end, a quick release safety attachment between the stirrup strap and the stirrup, comprising:

(a) opposite facing recesses at the open end of the stirrup;

(b) a sleeve extending across the open end of the stirrup, said sleeve resting in the loop at the bottom end of the stirrup strap;

(c) rod means nested axially in said sleeve having outer ends for removably engaging the recesses in said stirrup said rod means being at least in part movable;

(d) spring means in said sleeve coupled to the movable part of said rod means for applying a force axially on said movable part to disengage its end from its associated recess;

(e) means for applying a force axially on the movable part of said rod means opposite and greater than the spring means force to engage the outer end of said movable part with its associated recess; and (f) means for releasing said latter force from the movable part of said rod means.

2. The safety device as described in claim 1 further including means for holding said sleeve substantially non-rotatably in the stirrup strap loop.

3. The safety device as described in claim 2 wherein said means for applying a force to engage the end of the movable part of said rod means with the recess comprises finger means extending radially into said sleeve.

4. The safety device described in claim 3 wherein said finger means is attached to arm means, said arm means pivotally attached to said sleeve and extending upward from said sleeve between the sides of the stirrup strap.

5. The device as in claim 3 wherein said release means includes:

a slotted cap at the inner end of the movable part of said rod means, said finger means bearing against said cap; and means for rotating the movable part of said rod means until said finger means reaches the slot in said cap.

6. The device as in claim 5 wherein the recess engaged with the end of the movable part of said rod means is keyed and the end of the movable part of said rod means is keyed, the engaged end and recess comprising the means for rotating the movable part of said rod means.

7. In combination with a horse saddle fender, a stirrup strap extending downward from said fender folded back on itself forming a loop at its bottom end, and a stirrup extending down from said stirrup strap, said stirrup having an open upper end and a closed foot-support lower end, a quick release safety attachment between the stirrup strap and the stirrup, comprising:

(a) opposite facing recesses at the open end of the stirrup;

(b) a sleeve extending across the open end of the stirrup, said sleeve resting in the loop at the bottom end of the stirrup strap;

(c) movable rod means extending axially out of said sleeve having ends for engaging said recesses; and (d) means for axially moving said rod means to disengage the rod means ends from said recesses for separating the stirrup from the stirrup strap when the stirrup swings to a preset angle.

8. The safety device as in claim 7 including:

means for applying an inwardly directed axial force on said rod means for disengaging the ends of said rod means from said recesses;

means for applying an outwardly directed axial force on said rod means greater than said first-mentioned force for engaging the ends of said rod means within said recesses; and means for removing said latter force from said rod means when the stirrup swings to a preset angle.

9. The safety device as in claim 8 further including means for holding said sleeve substantially non-rotatable in the closed loop of the stirrup strap.

10. The safety device as in claim 9 wherein:

said means for applying an inwardly directed axial force comprises compressed spring means within said sleeve coupled to said rod means; and said means for applying an outwardly directed axial force comprises finger means extending radially into said sleeve bearing against the inner end of said rod means.

11. The safety device as in claim 10 wherein said means for removing the outwardly directed axial force from said rod means comprises means for removing the bearing contact of said finger means from the inner end of said rod means.

12. In combination with a horse saddle fender and a stirrup strap extending downward from said fender folded back on itself forming a loop at its bottom end:

(a) a stirrup having an open upper end and a closed foot-support lower end;

(b) a sleeve member resting in the loop at the bottom end of the stirrup strap extending across the open end of said stirrup;

(c) opposite facing recesses in said stirrup at its open end;

(d) means extending axially outward from said sleeve for removably engaging said recesses; and (e) means for axially disengaging said axially extending means from said recesses for separating the stirrup from the stirrup strap.

13. The combination as in claim 12 further including means for holding said sleeve substantially non-rotatable in the closed loop of the saddle strap.

14. The combination as in claim 13 wherein said axially extending means comprises movable rod means and further including:

spring means in said sleeve coupled to said rod means applying an axial force on said rod for axially disengaging said rod means from said stirrup recesses;

finger means extending radially into said sleeve bearing against said rod means for applying an axial force in excess of said spring means force on said rod means for engaging said rod means within said recesses; and means for removing said finger means from bearing against said rod means.

* * * * *